US009225071B2

(12) United States Patent
Lee et al.

(10) Patent No.: US 9,225,071 B2
(45) Date of Patent: Dec. 29, 2015

(54) ANTENNA ASSEMBLY FOR LONG-RANGE HIGH-SPEED WIRELESS COMMUNICATIONS

(71) Applicant: Ubiquiti Networks, Inc., San Jose, CA (US)

(72) Inventors: Jude Lee, Fremont, CA (US); Gerardo Huerta, San Jose, CA (US)

(73) Assignee: UBIQUITI NETWORKS, INC., San Jose, CA (US)

( * ) Notice: Subject to any disclaimer, the term of this patent is extended or adjusted under 35 U.S.C. 154(b) by 468 days.

(21) Appl. No.: 13/839,473

(22) Filed: Mar. 15, 2013

(65) Prior Publication Data

US 2013/0271337 A1 Oct. 17, 2013

Related U.S. Application Data

(60) Provisional application No. 61/621,396, filed on Apr. 6, 2012, provisional application No. 61/621,401, filed on Apr. 6, 2012.

(51) Int. Cl.
*H01Q 19/12* (2006.01)
*H01Q 1/12* (2006.01)
(Continued)

(52) U.S. Cl.
CPC ..... *H01Q 15/16* (2013.01); *H01Q 1/1207* (2013.01); *H01Q 1/1228* (2013.01); *H01Q 15/168* (2013.01); *H01Q 19/134* (2013.01); *H01Q 19/193* (2013.01); *H01Q 23/00* (2013.01)

(58) Field of Classification Search
CPC ..... H01Q 15/16; H01Q 1/1228; H01Q 19/12; H01Q 19/13
USPC ..... 343/840
See application file for complete search history.

(56) References Cited

U.S. PATENT DOCUMENTS 2,478,913 A * 8/1949 Goldberg ..... 343/818
5,625,368 A * 4/1997 Howson et al. ..... 343/753
(Continued)

FOREIGN PATENT DOCUMENTS

GB 2313957 A 12/1997

OTHER PUBLICATIONS

"Nanobridge M Quick Start Guide", Mar. 27, 2012, pp. 1-18, Retrieved from the Internet, http://dl.ubnt.com/guides/nanobridge/nanobridge_M_QSG.pdf.
(Continued)

*Primary Examiner* — Dameon E Levi
*Assistant Examiner* — Jennifer F Hu
(74) *Attorney, Agent, or Firm* — Shun Yao; Park, Vaughan, Fleming & Dowler LLP

(57) ABSTRACT

Various embodiments of antenna assemblies are disclosed herein. In one embodiment, the antenna assembly includes a reflector comprising a center opening, a feed-antenna subassembly situated in front of the reflector, a rear housing situated behind the reflector, and a pole-mounting bracket comprising a base plate situated between the reflector and the rear housing. The feed-antenna subassembly comprises a feed tube that houses at least one of: a transmitter circuit and a receiver circuit. The rear housing is coupled to a front side of the reflector via the center opening. The rear housing comprises a center cavity, and a back end of the feed tube is inserted in and coupled to the center cavity. The base plate is coupled to the reflector and the rear housing in such a way that decoupling between the base plate and the reflector requires a prior decoupling between the feed-antenna subassembly and the rear housing and a prior decoupling between the rear housing and the reflector.

30 Claims, 9 Drawing Sheets

(51) Int. Cl.

| | |
|---|---|
| ***H01Q 15/16*** | (2006.01) |
| ***H01Q 19/13*** | (2006.01) |
| ***H01Q 19/19*** | (2006.01) |
| ***H01Q 23/00*** | (2006.01) |

(56) References Cited

U.S. PATENT DOCUMENTS

| | | | | |
|---|---|---|---|---|
| 5,760,749 | A * | 6/1998 | Minowa et al. | 343/772 |
| 5,969,692 | A * | 10/1999 | Ishizuka | 343/840 |
| 6,966,532 | B2 * | 11/2005 | Ishizaki et al. | 248/274.1 |
| 8,674,885 | B2 * | 3/2014 | Leiba et al. | 343/702 |
| 2002/0105475 | A1 * | 8/2002 | Overton et al. | 343/878 |
| 2006/0001589 | A1 * | 1/2006 | Nicolae | 343/840 |
| 2007/0296642 | A1 * | 12/2007 | McCown | 343/840 |
| 2013/0313208 | A1 * | 11/2013 | Lin et al. | 211/13.1 |

OTHER PUBLICATIONS

"AirGrid M Datasheet", Feb. 19, 2011, pp. 1-6, Retrieved from the Internet, http://dl.ubnt.com/datasheets/airgridm/agmhp_datasheet_web.pdf.

"Streakwave: Ubiquiti Nanobridge M Series Product Overview—Streakwave.com", Jan. 12, 2012, Retrieved from the internet: URL:http://www.youtube.com/watch?v=DF_hx6iDIAM.

"wificentrum.com AirGrid M5", Jan. 27, 2010, Retrieved from the internet: URL:http://www.youtube.com/watch?v=L4Z99Uzz-Bc.

* cited by examiner

700

ANTENNA ASSEMBLY FOR LONG-RANGE HIGH-SPEED WIRELESS COMMUNICATIONS

RELATED APPLICATIONS

This application claims the benefit of U.S. Provisional Application No. 61/621,396, entitled "Dish Antenna Assembly," filed 6 Apr. 2012; and U.S. Provisional Application No. 61/621,401, entitled "Grid Antenna Assembly," filed 6 Apr. 2012; each of which is incorporated by reference in its entirely for all purposes.

BACKGROUND

1. Field

This disclosure is generally related to a wireless communication system. More specifically, this disclosure is related to an antenna assembly for high-speed, long-range wireless communication.

2. Related Art

The rapid development of optical fibers, which permit transmission over longer distances and at higher bandwidths, has revolutionized the telecommunications industry and has played a major role in the advent of the information age. However, there are limitations to the application of optical fibers. Because laying optical fibers in the field can require a large initial investment, it is not cost effective to extend the reach of optical fibers to sparsely populated areas, such as rural regions or other remote, hard-to-reach areas. Moreover, in many scenarios where a business may want to establish point-to-point links among multiple locations, it may not be economically feasible to lay new fibers. In addition, there is also a need for robust designs that can simplify installation process and provide enhanced mechanical reliability.

On the other hand, wireless radio communication devices and systems provide high-speed data transmission over an air interface, making it an attractive technology for providing network connections to areas that are not yet reached by fibers or cables. However, currently available wireless technologies for long-range, point-to-point connections encounter many problems, such as limited range and poor signal quality.

SUMMARY

One embodiment of the present invention provides an antenna assembly. The antenna assembly includes a reflector comprising a center opening, a feed-antenna subassembly situated in front of the reflector, a rear housing situated behind the reflector, and a pole-mounting bracket comprising a base plate situated between the reflector and the rear housing. The feed-antenna subassembly comprises a feed tube that houses at least one of: a transmitter circuit and a receiver circuit. The rear housing is coupled to a front side of the reflector via the center opening. The rear housing comprises a center cavity, and a back end of the feed tube is inserted in and coupled to the center cavity. The base plate of the pole-mounting bracket is coupled to the reflector and the rear housing in such a way that decoupling between the base plate and the reflector requires a prior decoupling between the feed-antenna subassembly and the rear housing and a prior decoupling between the rear housing and the reflector.

In a variation on this embodiment, the feed-antenna subassembly further comprises a sub-reflector coupled to at least one of: the transmitter circuit and the receiver circuit.

In a variation on this embodiment, the at least one of the transmitter circuit and the receiver circuit is located on a printed circuit board (PCB). The PCB further comprises a data port that is physically accessible via a window on the feed tube and a corresponding window on the rear housing.

In a further variation, the data port is an Ethernet port, and the Ethernet port enables power over Ethernet.

In a variation on this embodiment, the feed tube is coupled to the center cavity of the rear housing via a push latch.

In a variation on this embodiment, the base plate of the pole-mounting bracket is coupled to the reflector via a slide-latch mechanism.

In a further variation, the rear housing is coupled to the reflector via a number of push latches that are pushed through the center opening of the reflector. The rear housing further comprises an outer shell that is coupled to both the reflector and the base plate of the pole-mounting bracket.

In a further variation, the outer shell includes a number of extruding studs that are inserted into a number of holes on the reflector via corresponding through holes on the base plate, thereby serving as precision locator pins, accommodating for tolerances in fabrication, and preventing slip between the assembly joints.

In a variation on this embodiment, the reflector includes one of: a parabolic dish and a parabolic grid.

In a variation on this embodiment, the back plate of the pole-mounting bracket is coupled to a pole clamp for mounting onto a pole, and the pole clamp is configured to rotate within a predetermined range against a pivot point on the back plate.

One embodiment of the present invention provides a pole-mounted radio. The pole-mounted radio includes a wireless receiver and/or transmitter circuit, an L-shaped pole-mounting bracket for mounting the radio onto a pole, a reflector, and a feed antenna. The pole-mounting bracket includes a back plate coupled to the pole and a base plate. The reflector is attached to the base plate of the pole-mounting bracket via a slide latching mechanism. A center opening on the reflector is aligned to a center opening on the base plate. The feed antenna passes through center openings on the reflector and the base plate. The feed antenna includes a feed tube that houses the receiver and/or transmitter circuit and a supporting housing that supports the feed tube. The supporting housing is attached to the reflector via a number of push latches that are pushed through the center openings on the reflector and the base plate. The supporting housing further comprises a number of locator pins coupled to both the reflector and base plate, and the locator pins accommodate fabrication tolerance and act as a lock for the slide latching mechanism.

In a variation on this embodiment, the feed antenna further includes a sub-reflector coupled to the receiver and/or transmitter circuit.

In a variation on this embodiment, a portion of the feed tube is inserted into a center cavity on the supporting housing. The portion of the feed tube includes an access window for accessing a data port on a printed circuit board (PCB) enclosed within the feed tube.

In a further variation, the data port is an Ethernet port that enables power over Ethernet.

In a variation on this embodiment, the reflector includes one of: a parabolic dish and a parabolic grid.

In a further variation, if the reflector includes a parabolic grid, the parabolic grid can be attached to the back plate of the pole-mounting bracket in an orientation that includes one of: a first orientation corresponding to a horizontal polarity, and a second orientation corresponding to a vertical polarity.

BRIEF DESCRIPTION OF THE FIGURES

In the figures, like reference numerals refer to the same figure elements.

All dimensions marked in the figures are in millimeters.

DETAILED DESCRIPTION

The following description is presented to enable any person skilled in the art to make and use the embodiments, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present invention is not limited to the embodiments shown, but is to be accorded the widest scope consistent with the principles and features disclosed herein.

Overview

Embodiments of the present invention provide an easy-to-install antenna assembly for a high-speed, long-range radio. In one variation, the antenna assembly includes a highly directive reflector, a feed-antenna subassembly that houses electronic components of the radio and a sub-reflector, a rear housing unit, and a pole-mounting bracket. The unique self-locking design of the different components of the antenna assembly allows a customer to install the radio system without the need for special tools. The antenna assembly can support radios operating at different frequencies. In one variation, the highly directive reflector is a dish reflector. In an additional variation, the highly directive reflector is a grid reflector.

Dish Antenna Assembly

Figure 1:
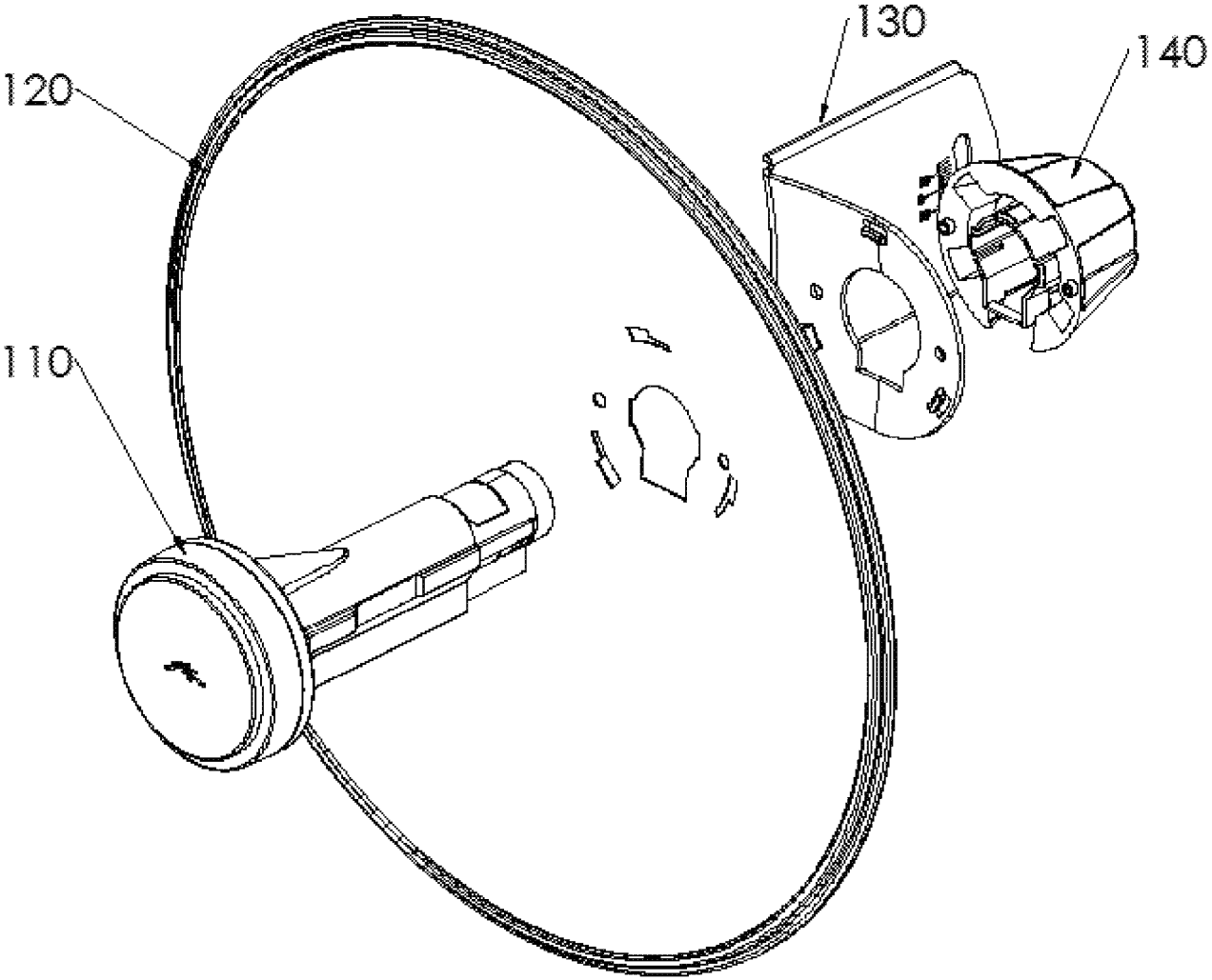
FIG. 1 presents an assembly view of an exemplary dish antenna assembly, in accordance with an embodiment of the present invention.

FIG. 1 presents an assembly view of an exemplary dish antenna assembly, in accordance with an embodiment of the present invention. In FIG. 1, dish antenna assembly 100 includes a feed-antenna subassembly 110, a dish reflector 120, a pole-mounting bracket 130, and a rear housing 140.

Feed-antenna subassembly 110 houses the electronic components, including but not limited to transmitting and receiving circuits. In one variation, the transmitting and receiving circuits, including filters, amplifiers, modulators, etc., are co-located on a single printed circuit board (PCB). Dish reflector 120 is the main antenna reflector of the radio. If the radio is transmitting, dish reflector 120 projects radio waves to the air; if the radio is receiving, dish reflector 120 reflects radio waves collected from the air to a sub-reflector. Pole-mounting bracket 130 allows dish antenna assembly to be mounted onto a pole. Rear housing 140 provides support to feed-antenna subassembly 110 and locks dish reflector 120 onto pole-mounting bracket 130.

Figure 2A:
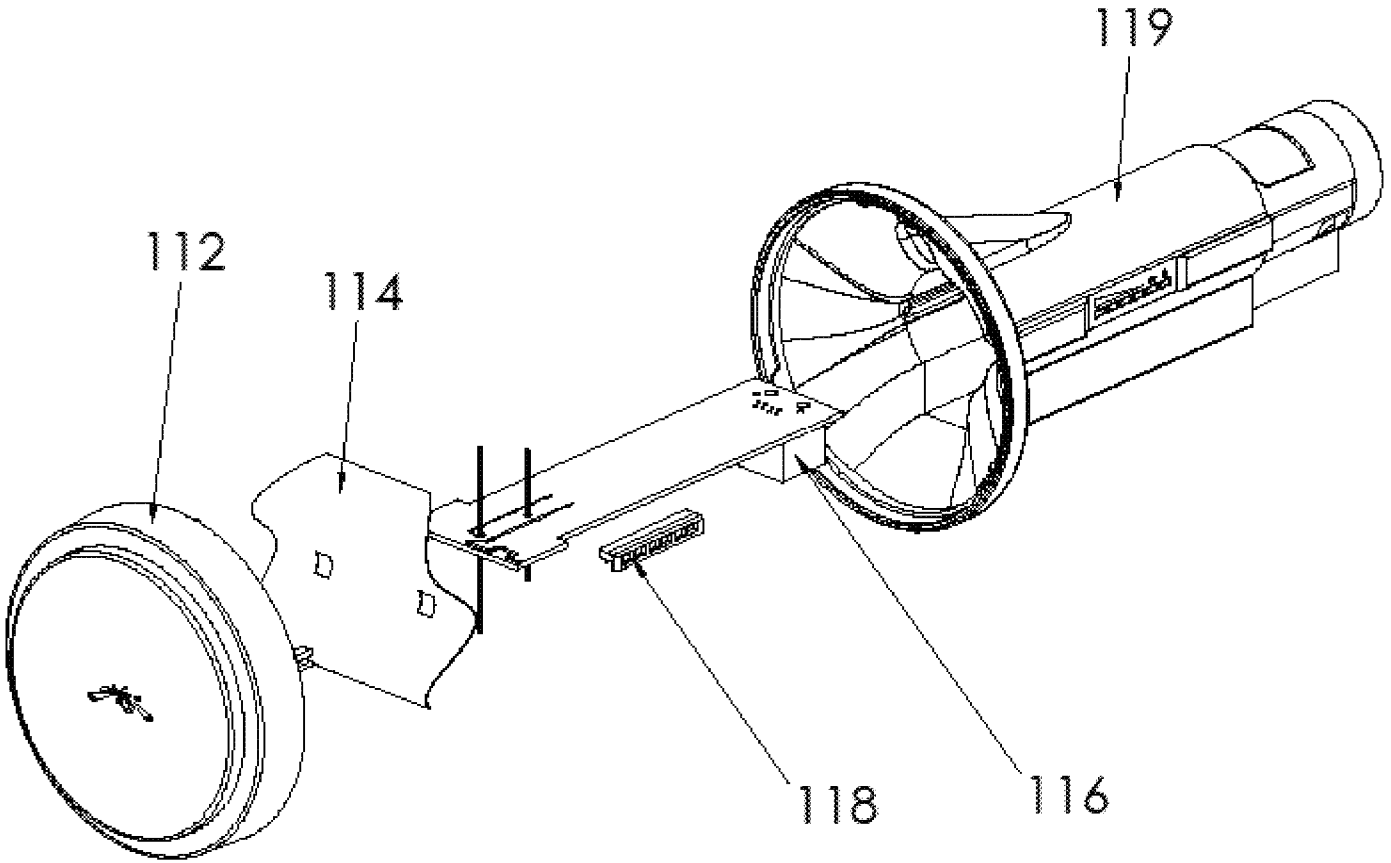
FIG. 2A presents an assembly view of an exemplary feed-antenna subassembly, in accordance with an embodiment of the present invention.

FIG. 2A presents an assembly view of an exemplary feed-antenna subassembly, in accordance with an embodiment of the present invention. In FIG. 2A, feed-antenna subassembly 110 includes a feed cap 112, a sub-reflector 114, a PCB 116, a light divider 118, and a feed body 119. Feed cap 112 and feed body 119 form an enclosed cavity and house sub-reflector 114 and PCB 116. PCB 116 includes electronics components of the radio, which can include but are not limited to: filters, amplifiers, modulators, demodulators, and network/power interfaces, etc. In one variation, PCB 116 includes an Ethernet interface that provides network connection and power (via power over Ethernet (PoE)) to other radio components on PCB 116. Sub-reflector 114 couples to the receiving and transmitting circuitry on PCB 116, and collects radio waves from or reflects radio waves to dish reflector 120. Note that feed body 119 is transparent to radio waves. Based on the operating frequency, sub-reflector 114 may have different shapes and sizes. In one variation, other components within feed-antenna subassembly 110, such as feed cap 112 and feed body 119, also vary in size and/or shape according to the operating frequency of the radio. However, the way that feed antenna subassembly 110 coupled to dish reflector 120 and rear housing 140 remains the same. Note that the physical closeness between sub-reflector 114 and other radio components on PCB 116 not only ensures the radio being compact in size, but also eliminates the need for an external cable to connect the sub-reflector to other radio components, thus obviating the need to tune antenna when transmitting.

Figure 2B:
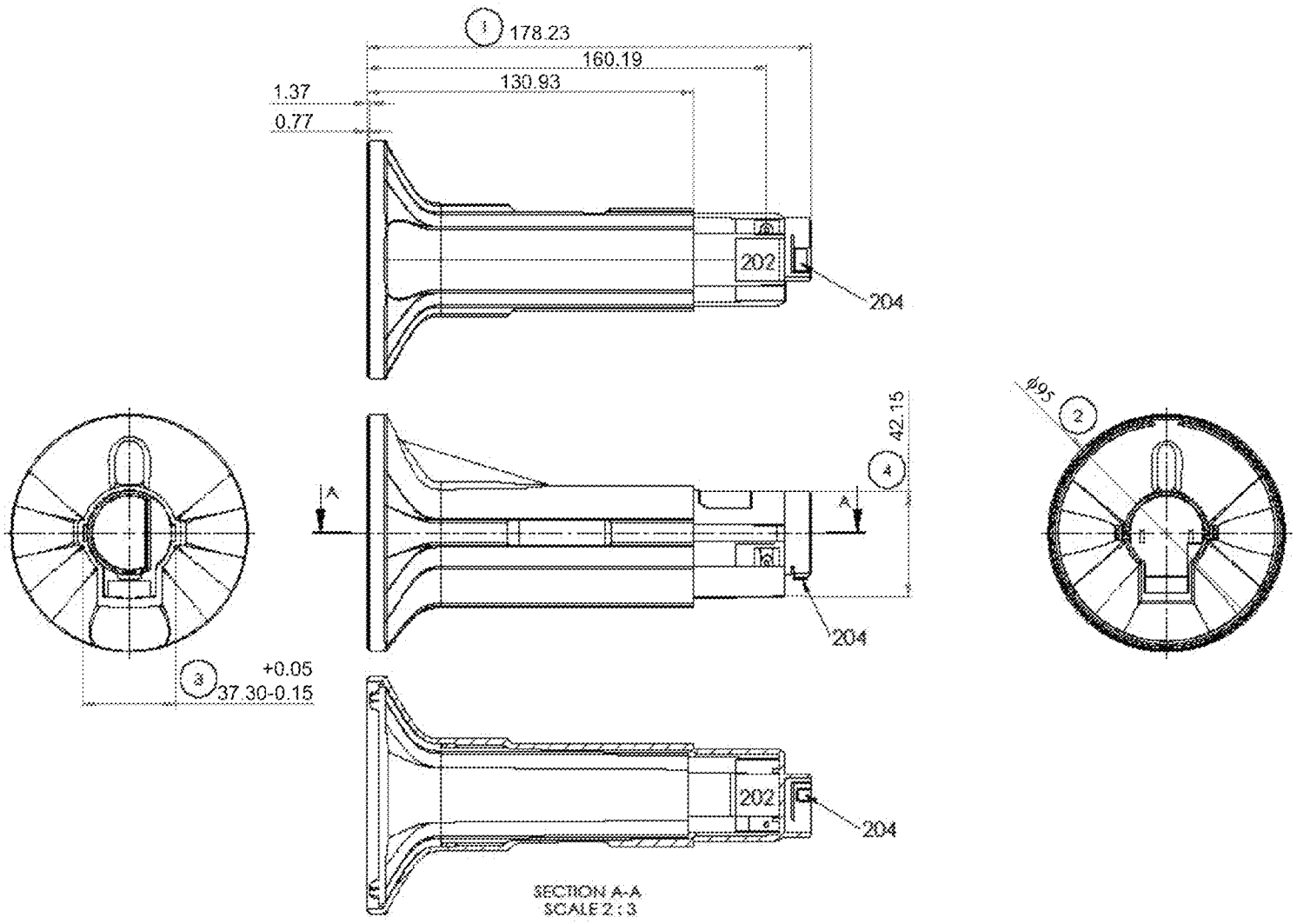
FIG. 2B illustrates a detailed mechanical drawing of an exemplary feed body, in accordance with an embodiment of the present invention.

FIG. 2B illustrates a detailed mechanical drawing of an exemplary feed body, in accordance with an embodiment of the present invention. More specifically, FIG. 2B provides exemplary dimensions of the feed body. In the example shown in FIG. 2B, all lengths are expressed in millimeters. In one variation, the feed body is made of hard plastic material, such as polyvinyl chloride (PVC).

In FIG. 2B, the top center drawing shows the top view of the feed body. The middle center drawing shows the side view of the feed body, and the bottom center drawing shows the cross-sectional view of the feed body along the cutting plane A-A. The right and left drawings are the front and back views of the front opening of the feed body, respectively.

From FIG. 2B one can see that at the back end of the feed body there is an opening 202 and a push latch 204. Opening 202 provides physical access to a port, such as an RJ48 port on the PCB enclosed inside the feed body. In one variation, a user can connect an Ethernet cable to the RJ48 port on the PCB, thus providing network connection and power to components on the PCB. Push latch 204 includes a portion that extrudes out of the surface of the feed body. This extruded portion latches to an opening in the rear housing, thus coupling the feed body (and, therefore, the feed-antenna subassembly) with the rear housing. In addition, an L-shaped slit separating push latch 204 from other portions of the feed body acts like a spring, making it possible for push latch 204 to be pushed inward by a person's thumb or by the sidewall of the rear housing.

Figure 3:
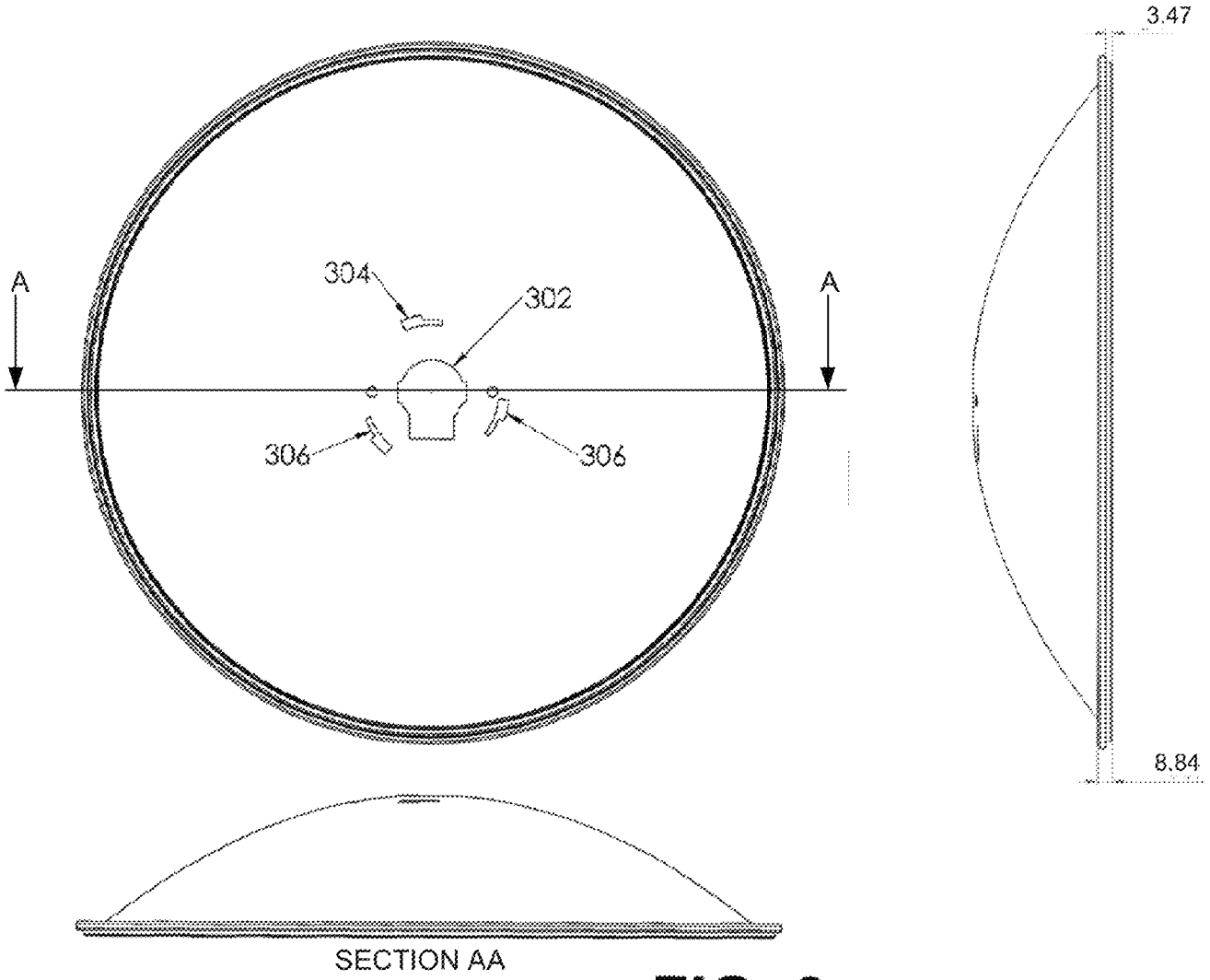
FIG. 3 illustrates a detailed mechanical drawing of an exemplary dish reflector, in accordance with an embodiment of the present invention.

FIG. 3 illustrates a detailed mechanical drawing of an exemplary dish reflector, in accordance with an embodiment of the present invention. The center drawing provides a front view of the dish reflector, the right-hand drawing provides a side view of the dish reflector, and the bottom drawing provides a cross-sectional view of the dish reflector along cutting plane A-A. In FIG. 3, all lengths are in millimeters and angles are in degrees.

From FIG. 3, one can see that the dish reflector includes a large center opening 302 and a number of slots 304-308. Large center opening 302 is designed in such a way that allows the back end of the feed body to go through large center opening 302 to couple to the rear housing. Slots 304-308 enable secure attachment of the pole-mounting bracket. In one variation, a slot is shaped like a deformed L with the back of the L being wider and shorter than the back of a normal L. Note that the inner and outer edges of slots are aligned with latitude lines on the dish to enable rotation of inserted latches. In one variation, the arc length of the base of the L is at least twice that of the back of the L. Note that the shape, size, location, and number of slots shown in FIG. 3 are merely exemplary. In practice, the shape, size, location, and number of the slots can vary. For example, a dish reflector may include additional or fewer slots, or the slots may be located along different latitude lines (in the example shown in FIG. 3, all slots are located on a same latitude line), as long as the slots enable latching between the pole-mounting bracket and the dish reflector.

Figure 4A:
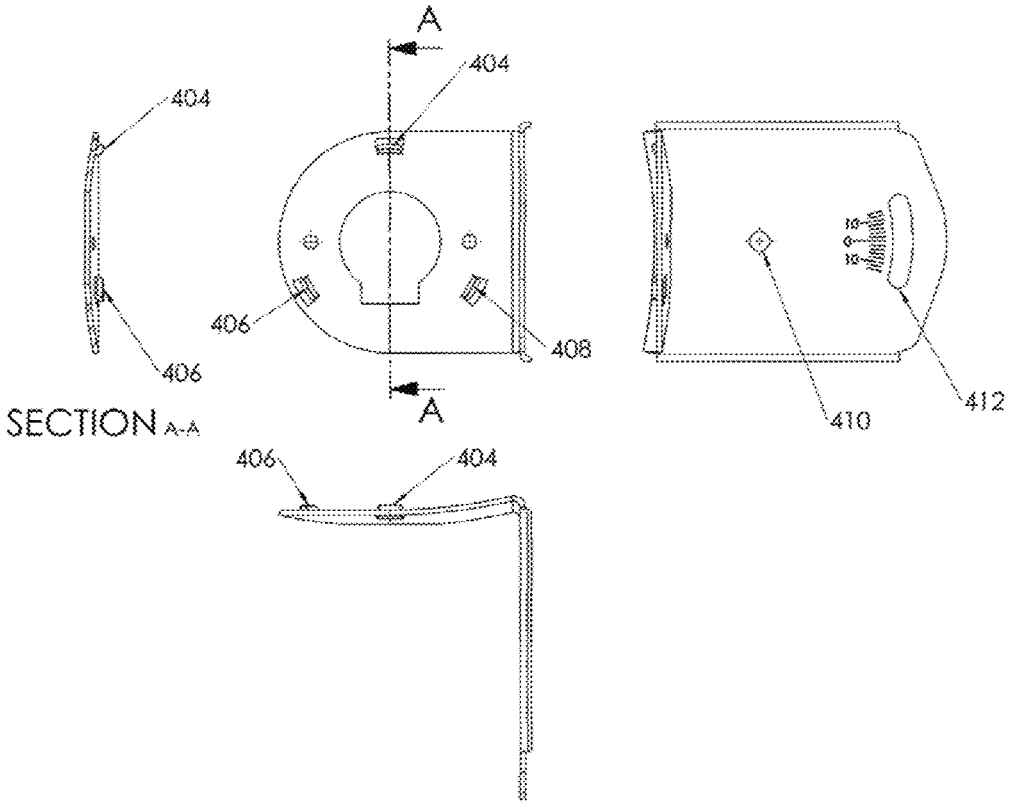
FIG. 4A illustrates a detailed mechanical drawing of an exemplary pole-mounting bracket, in accordance with an embodiment of the present invention.

FIG. 4A illustrates a detailed mechanical drawing of an exemplary pole-mounting bracket, in accordance with an embodiment of the present invention. For durability concerns, in one variation, pole-mounting bracket is made of a metal material, such as aluminum or stainless steel.

In FIG. 4A, the top center drawing shows the front view (looking into the back of the dish reflector in reference to FIG. 1) of the pole-mounting bracket. The bottom center drawing shows the top view of the pole-mounting bracket, the right-hand drawing shows the left view of the pole-mounting bracket, and the left-hand drawing shows the cross-sectional view of the pole-mounting bracket across cutting plane A-A.

Combined with the 3-D image of the pole-mounting bracket shown in FIG. 1, one can see that the pole-mounting bracket is an L-shaped bracket. When assembled, the base of the L is attached to the back surface of the dish reflector. FIG. 4A illustrates that the base of the pole-mounting bracket is curved to match the curvature on the dish reflector.

From FIG. 4A, one can see that the base plate of the pole-mounted bracket includes a large center opening 402, and a number of latches 404-408. Note that, compare with the large center opening on the dish reflector, large center opening 402 has a similar shape and a larger size, thus allowing a portion of the rear housing to extrude through large center opening 402 to couple to the front side of the dish reflector.

The latches (such as latches 404, 406, and 408) on the base plate of the pole-mounting bracket extrude out of the surface of the base plate and tilt slightly toward the base plate. Each latch is shaped as a deformed L with a narrower back portion and a wider base portion. The back of the L is attached to the base plate at an angle. Moreover, the locations of the latches correspond to the locations of slots (such as slots 304, 306, and 308) on the dish reflector. In one variation, these latches (which are made of metal) are non-bendable. When assembling the antenna, a user can attach the base plate of the pole-mounting bracket to the back of the dish reflector by inserting the latches on the base plate into the L-shaped slots on the dish reflector. More specifically, the latches can be inserted into the slots through the wider portion of the slots (the back of the L). The tilted angle and the wider base of the extruded latches prevent these latches from being able to be inserted into the slots through their narrower portion. Afterwards, the user can rotate the base plate of the pole-mounting bracket against the dish reflector to let the latches (more precisely, the narrower back portion of the L) slide into the narrower portion of the slots. Once positioned in the narrower portion of the slot, the wider base portion of a latch latches to the front surface of the dish reflector, thus preventing the pole-mounting bracket from being pulled away from the reflector. To remove the pole-mounting bracket, a rotation is needed to slide the latches out of the narrow portion of the slots and into the wider portion of the slots on the dish reflector. Note that while attaching the pole-mounting bracket to the reflector dish, one needs to make sure the center openings on these two pieces are aligned.

Figure 4B:
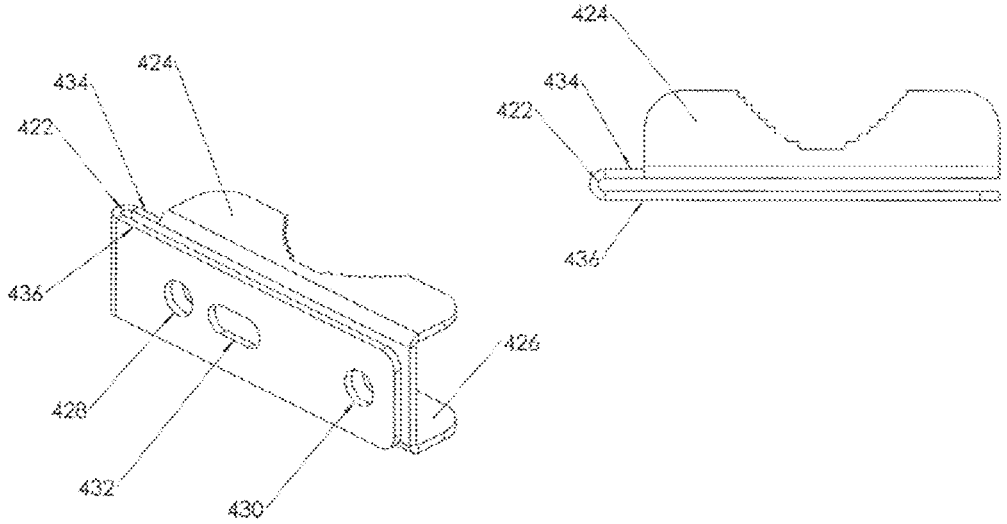
FIG. 4B illustrates an exemplary pole clamp, in accordance with an embodiment of the present invention.

FIG. 4A also illustrates that the back plate of the pole-mounting bracket includes a round hole 410 and a curved slot 412. Round hole 410 and curved slot 412 enable coupling between the pole-mounting bracket and a pole clamp via a U-bolt. FIG. 4B illustrates an exemplary pole clamp, in accordance with an embodiment of the present invention. The left-hand drawing in FIG. 4B shows the pole clamp in 3-D, and the right-hand drawing shows the side view of the pole clamp.

From FIG. 4B, one can see that the pole clamp includes a U-shaped clamp body 422 and a pair of jaws 424 and 426. The U-shaped clamp body 422 further includes a clamp base 434 on one side of the U and a lance 436 on the other. Clamp base 434 supports jaws 424 and 426. On the other hand, lance 436 acts as a larger washer for to prevent fasteners (not shown in the figure) from scraping paint of the back plate of the pole-mounting bracket, which, once installed, is sandwiched between clamp base 434 and lance 436, via the opening of the U. Note that such a design helps to maintain protections of the pole-mounting bracket from corrosions in an outdoor environment. A pair of through holes, holes 428 and 430, and a through slot 432 penetrate both clamp base 434 and lance 436. The positions of through holes 428 and 430 correspond to the positions of hole 410 and slot 412 on the back plate of the pole-mounting bracket. A U-shaped bolt along with matching nuts (not shown in the figure) can be used to couple the pole clamp and the back plate of the pole-mounting with the ends of the U going through holes 428 and 430 on the pole clamp and corresponding slot 412 and hole 410 on the back plate of the pole-mounting bracket. More specifically, one end of the U-bolt passes through holes 410 and 430 and forms a pivot point, and the other end of the U-bolt passes through hole 430 and slot 412, making it possible for the pole clamp to rotate along slot 412 against the pivot point. The bottom of the U of the U-shaped bolt and jaws 424 and 426 form a ring-like structure that can attach to the outer surface of a circular-shaped pole. Note that jaws 424 and 426 include step-shaped surfaces for better gripping onto the pole. Because the pole clamp and the U-bolt are clamped onto the pole and form a horizontal plane, the pole-mounting bracket can tilt relative to this horizontal plane in a range that is defined by slot 412. The position of slot 432 corresponds to the angle markings on the back plate of the pole-mounting bracket, thus allowing a user to see at what angle the pole-mounting bracket, and thus the antenna, is mounted onto the pole.

Figure 5:
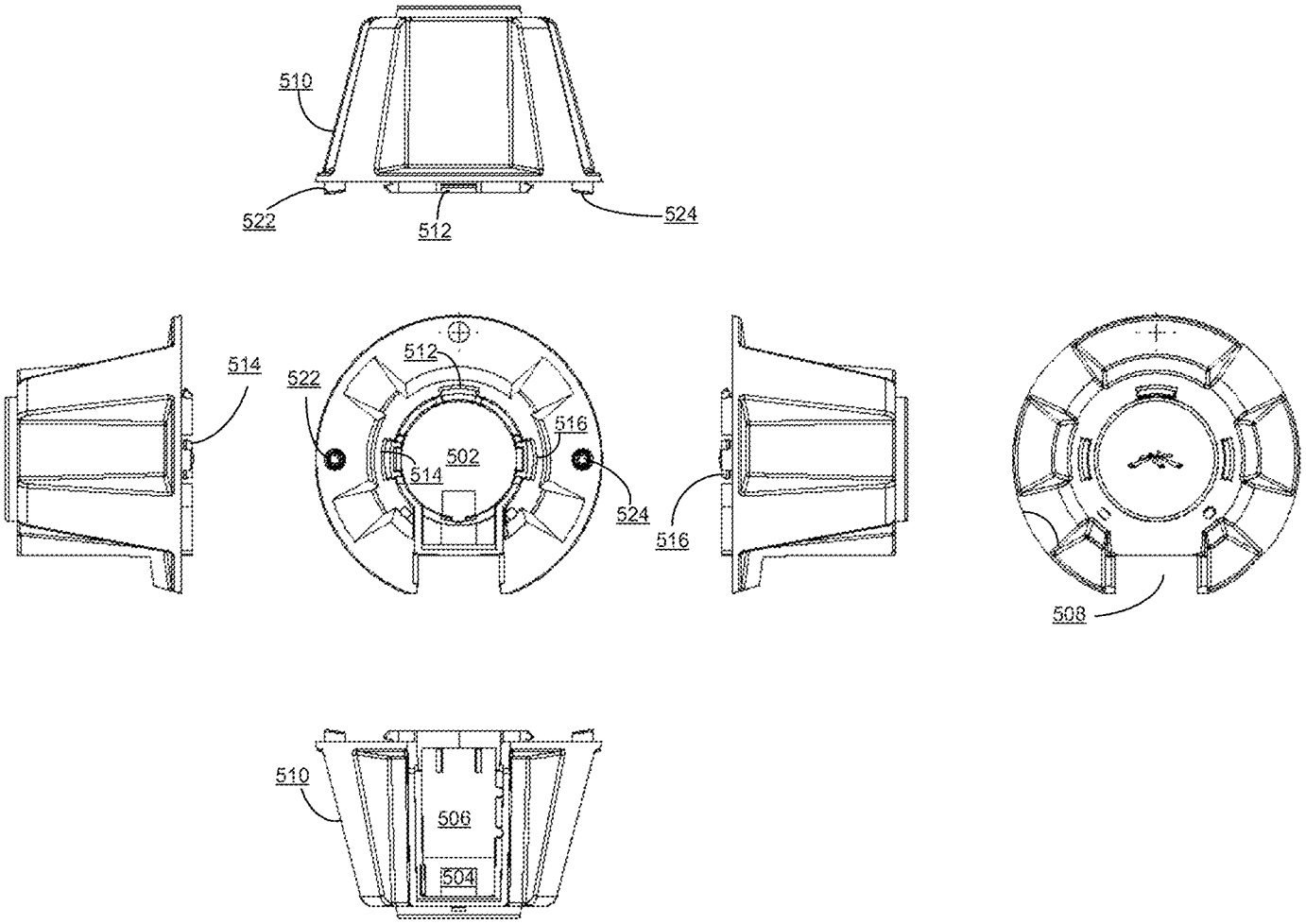
FIG. 5 illustrates a detailed mechanical drawing of an exemplary rear housing, in accordance with an embodiment of the present invention.

FIG. 5 illustrates a detailed mechanical drawing of an exemplary rear housing, in accordance with an embodiment of the present invention. In one variation, the rear housing is made of a hard plastic material, such as PVC. FIG. 5 shows six different views of the rear housing, including the front view (looking away from the back of the dish reflector in reference to FIG. 1) of the rear housing (middle row, second to the left); the bottom view (top row); the top view (bottom row); the right-side view (middle row, far left); the left-side view (middle row, second to the right); and the rear view (middle row, far right) of the rear housing.

From FIG. 5, one can see that the rear housing includes a center cavity 502. The size and shape of center cavity 502 correspond to the back end of the feed body, thus allowing the feed-antenna subassembly to be inserted and snugly fitted into center cavity 502. The sidewall of center cavity 502 includes a small opening 504 and large opening 506. The location and size of small opening 504 correspond to push latch 204 located on the feed body. When the feed body is inserted into center cavity 502, push latch 204 is pushed into small opening 504 and latches to the sidewall of center cavity 502, thus enabling secure coupling between the feed-antenna subassembly and the rear housing. To decouple the feed-antenna subassembly and the rear housing, one can apply an inward force on push latch 204 via small opening 504 while pulling the feed-antenna subassembly away from the rear housing. Note that the sidewall of center cavity 502 may also include a number of slots that fit a number of extrusions on the feed body, thus ensuring better fitting and coupling between the back end of the feed body and center cavity 502.

The location of large opening 506 on sidewall of center cavity 502 corresponds to the location of opening 202 on the feed body, thus allowing physical access to the network/power port on the PCB enclosed in the feed-antenna subassembly. In one variation, the rear housing also includes a side cover that fits to slot 508 and covers small opening 504 and large opening 506 while allowing a cable to couple to the RJ48 port on the PCB.

In addition to housing the back end of the feed-antenna subassembly, the rear housing also provides support to the feed-antenna subassembly by attaching itself securely to the dish reflector. In addition, the attachment of the rear housing also locks the coupling between the dish reflector and the pole-mounting bracket. More specifically, the coupling between the rear housing and the dish reflector is provided by a number of push latches, including push latches 512, 514, and 516. Note that a respective push latch, such as push latch 512, can be formed by cutting trenches on both sides of a small rectangular portion of the sidewall of center cavity 502, separating that rectangular portion from the rest of the sidewall. Each latch also has a tapered front end. When assembling the antenna, one can push the sidewall of center cavity 502 through the center openings on the pole-mounting bracket and the dish reflector (note that the pole-mounting bracket is attached to the dish reflector with latches on the pole-mounting bracket slid into the narrow base portions of L-shaped slots on the dish reflector). Because the shape and size of the center opening on the dish reflector match the shape and size of sidewalls of center cavity, once pushed in, push latches 512-516 latch to the edge of the center opening on the dish reflector, thus attaching the rear housing to the dish reflector. Note that outer shell 510 of the rear housing has a curved surface that matches the contour of the backside of the dish reflector and the base plate of the pole-mounting bracket. Also note that the height of outer shell 510 is designed to be lower than the height of the sidewall of center cavity 502. In one variation, the height difference is determined by the thickness of the base plate of the pole-mounting bracket and the thickness of the dish reflector. Hence, when the rear housing is pushed against the backside of the dish reflector, the extruded portion of the center cavity sidewall can be pushed though the center openings of both the pole-mounting bracket and the dish reflector, with latches 512-516 latching to the edges of the center opening on the dish reflector, and outer shell 510 pushed to fit snugly against the back surface of the base plate of the pole-mounting bracket. One can refer to FIG. 1 for the relative positions of the dish reflector, the pole-mounting bracket, and the rear housing. As one can see, the base plate of the pole-mounting bracket is sandwiched between the dish reflector and the rear housing.

Outer shell 510 also includes two extruding circular studs 522 and 524. When pushed against the backside of the dish reflector, circular studs 522 and 524 fit into corresponding holes situated on the base plate of the pole-mounting bracket and holes situated on the dish reflector. Note that once circular studs 522 and 524 are inserted into holes on the base plate of the pole-mounting bracket and holes on the dish reflector, any rotation of the pole-mounting bracket relative to the dish reflector is prevented. In other words, circular studs 522 and 524 can serve as precision locator pins, which prevent any possible slip between the assembly joints, such as a slip between the dish reflector and the base plate. Another function of circular studs 522 and 524 is to accommodate for tolerances in the fabrication of the different antenna components. The non-circular shape of the center openings and center cavity 502 also help prevent possible slips between the dish reflector and the base plate of the pole-mounting bracket. Hence, the attachment of the rear housing to the dish reflector via push latches 512-516 serves an additional purpose of locking the pole-mounting bracket to the dish reflector. As a result, one needs to remove the rear housing before decoupling the pole-mounting bracket and the dish reflector. Note that one can remove the attached rear housing from the dish reflector by simultaneously pushing all push latches (including push latches 512-516) while pulling the rear housing away from the dish reflector.

Figure 6:
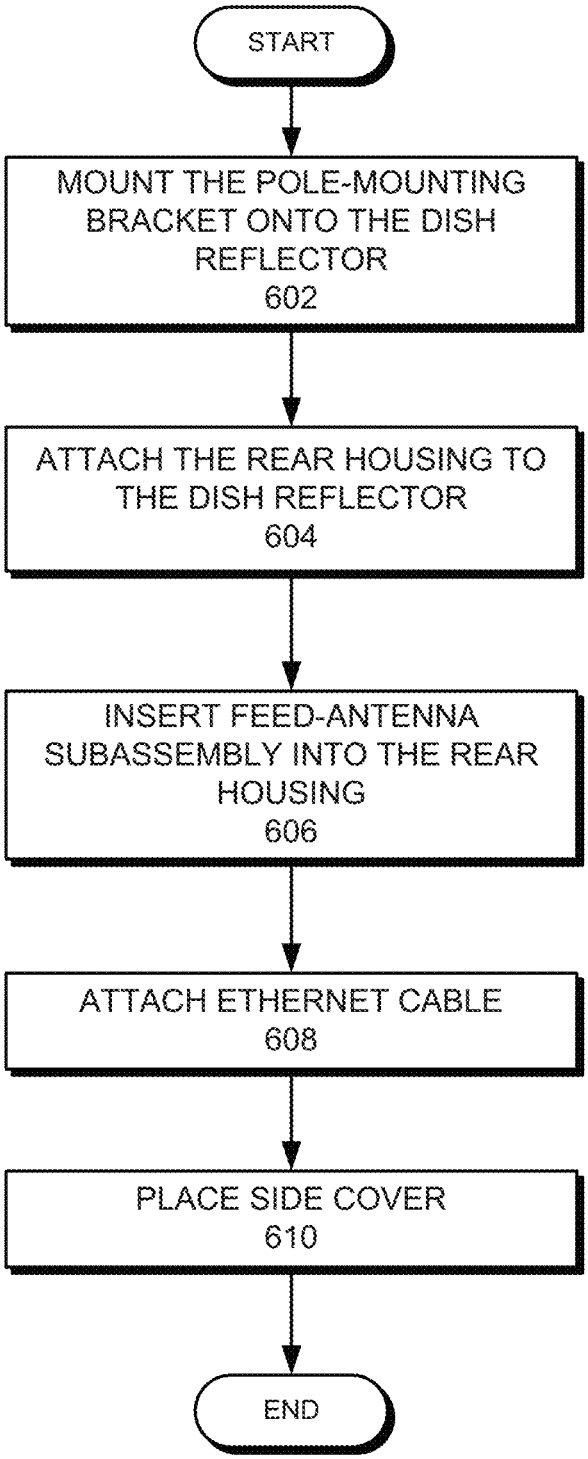
FIG. 6 presents a flowchart illustrating an exemplary process of assembling a dish antenna assembly, in accordance with an embodiment of the present invention.

FIG. 6 presents a flowchart illustrating an exemplary process of assembling a dish antenna assembly, in accordance with an embodiment of the present invention. When assembling the dish antenna, the user first mounts the pole-mounting bracket onto the backside of the dish reflector (operation 602). In one embodiment, the latches that extrude out of the surface of the base plate of the pole-mounting bracket are inserted into L-shaped slots on the bottom of the dish reflector, and the base plate is then rotated along the slot to allow the narrow back portion of the latches to slide into the narrow portion of the L-shaped slots.

Subsequently, the user can attach the rear housing to the dish reflector (operation 604). In one variation, the rear housing is attached to the dish reflector by a number of push latches that are pushed through center openings on both the dish reflector and the base plate of the pole-mounting bracket. The push latches latch to the edge of the center opening on the dish reflector. Note that the number and location of the push latches may be different from the example shown in FIG. 5. In addition, a pair of studs on the outer shell of the rear housing is pushed into corresponding holes on both the dish reflector and the base plate, thus locking the relative positions of the base plate and the dish reflector. As a result, one needs to remove the rear housing before decoupling the base plate and the dish reflector.

Once the rear housing is attached to the dish reflector, the user can insert the back end of the feed-antenna subassembly into the center cavity of the rear housing (operation 606). Note that a push latch can be used to securely attach the feed-antenna subassembly to the rear housing. A user can then connect a cable, such as an Ethernet cable, to the network/power port (which can include an RJ48 connector) on the PCB housed within the feed-antenna subassembly (operation 608). In one variation, the network/power port is accessible via openings on both the feed body and the rear housing. After attaching the cable, the user can put the side cover of the rear housing in place (operation 610), and the dish antenna is ready to be mounted onto a pole. Note that the assembly process includes simple inserting and clicking operations. A user can perform these operations without the need for any tools. The dissembly process involves detaching the push latches and can also be performed without using any tools.

Grid Antenna Assembly

Figure 7:
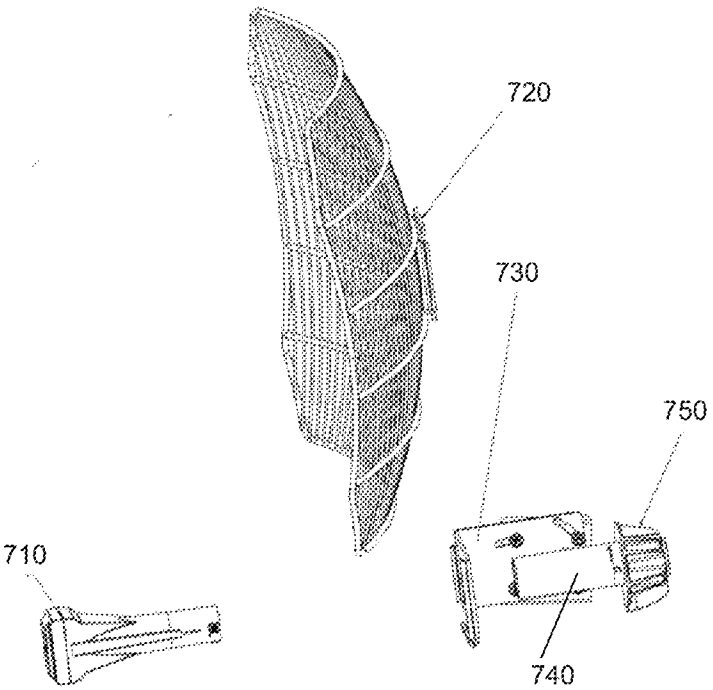
FIG. 7 presents an assembly view of an exemplary grid antenna assembly, in accordance with an embodiment of the present invention.

In addition to a dish reflector, it is also possible to use other types of reflectors, such as a wire grid-type parabolic reflector. In some embodiments, the assembly of a grid-type antenna is similar to the dish antenna with the exception that the grid antenna assembly can be assembled into two different orientations for the two polarization modes, horizontal or vertical. FIG. 7 presents an assembly view of an exemplary grid antenna assembly, in accordance with an embodiment of the present invention. In FIG. 7, grid antenna assembly 700 includes a feed-antenna subassembly 710, a grid reflector 720, a pole-mounting bracket 730, an optional extension tube 740, and a rear housing 750.

The structure of feed-antenna subassembly 710 is similar to that of the feed-antenna subassembly in the dish antenna, except that the size and shape of feed-antenna subassembly 710 are carefully designed to work with grid reflector 720. In addition, depending on the operating frequency, a user can choose feed-antenna subassemblies with different sizes and shapes. These different types of feed-antenna subassemblies are designed to fit into rear housing 750 and/or extension tube 740.

Grid reflector 720 includes a grill of parallel wires. When the wires are oriented horizontally, a horizontal polarization is achieved; when the wires are oriented vertically, a vertical polarization is achieved. Note that the polarization of a grid antenna needs to match the orientation of its corresponding device (horizontal to horizontal, vertical to vertical). For example, if the transmitting device has a horizontal polarization, the receiving antenna needs to be oriented so that it has a horizontal polarization as well.

Pole-mounting bracket 730 also has a similar structure to that of the pole-mounting bracket in the dish antenna assembly. A slide latch mechanism can be used to attach the base plate of pole-mounting bracket 730 onto grid reflector 720. More specifically, grid reflector 720 includes a mounting bracket having a number of slide bars, and the base plate of pole-mounting bracket 730 includes a number of latches that match the slide bars. A user can slide the base plate of pole-mounting bracket 730 against the mounting bracket on grid reflector 720 to attach pole-mounting bracket 730 to grid reflector 720.

After pole-mounting bracket 730 has been attached to grid reflector 720, rear housing 750 is snapped into place on the mounting bracket of grid reflector 720. Rear housing 750 is similar to the rear housing in the dish antenna assembly. In one variation, a number of push latches on rear housing 750 latch to the edge of a center opening on the mounting bracket of grid reflector 720 when these push latches are pushed through such a center opening. Once in place, rear housing 750 not only securely attaches to grid reflector 720, but also locks the base plate of pole-mounting bracket 730 to the mounting bracket on grid reflector 720. More specifically, the attachment of rear housing 750 to the mounting bracket on grid reflector 720 prevents the base plate of pole-mounting bracket 730 from sliding off the mounting bracket on grid reflector 720. To decouple pole-mounting bracket 730 and grid reflector 720, one needs to first remove rear housing 750.

Rear housing 750 includes a center cavity that houses feed-antenna subassembly 710. Optionally, an extension tube 740 is used for coupling feed-antenna subassembly 710 and rear housing 750. When the radio is operating at a certain frequency band, extension tube 740 provides additional distance needed between the sub-reflector in feed-antenna subassembly 710 and grid reflector 720. When extension tube 740 is needed, it is inserted into rear housing 750, and the back end of feed-antenna subassembly 710 is inserted into extension tube 740. Otherwise, the back end of feed-antenna subassembly 710 is directly inserted into rear housing 750. Similarly to the dish antenna system, push latches can be used to couple feed-antenna subassembly 710 to rear housing 750 or extension tube 740.

Figure 8:
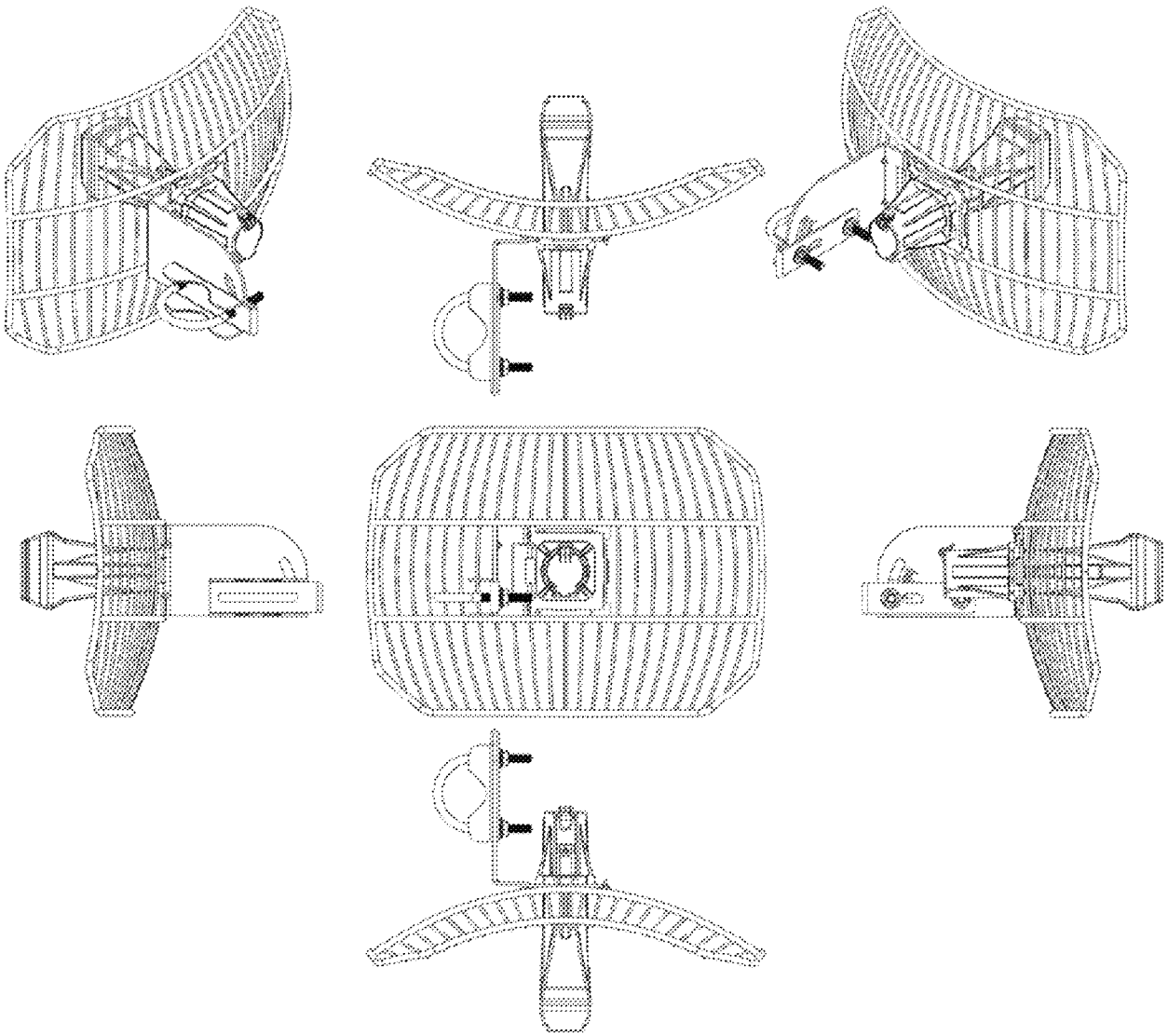
FIG. 8 illustrates the assembled grid antenna viewed from different angles, in accordance with an embodiment of the present invention.

FIG. 8 illustrates the assembled grid antenna viewed from different angles, in accordance with an embodiment of the present invention. The middle drawing in the center row illustrates the back view of the grid antenna. The middle drawings in the top and bottom rows illustrate the top and bottom views of the grid antenna, respectively. The left-hand and right-hand drawings in the middle row illustrate the right-side and left-side views of the grid antenna, respectively. The left-hand and right-hand drawings in the top row are isometric views of the grid antenna.

Note that although the grid antenna assembly has a different shape and dimensions compared with the dish antenna assembly, the basic design principle for these two antenna systems is similar. Both systems provide a high-speed, long-range radio that can be used for wireless communication. Various electronic components of the radio system are placed onto a single PCB and the PCB is enclosed in the feed-antenna subassembly. Such a design not only ensures the radio being compact in size, but also eliminates the need for an external cable that connects the sub-reflector and other radio components. The various components, including the reflector, the feed-antenna subassembly, the pole-mounting bracket, and the rear housing, are assembled in such a way that no special hardware is needed. The push latch mechanisms that are used to couple the components together can be manipulated easily by hand. Moreover, the rear housing includes a locking mechanism that can lock the coupling between the pole-mounting bracket and the reflector. Such a locking mechanism is activated when the rear housing is latched onto the reflector, and can only be deactivated by removing the rear housing.

The foregoing descriptions of various embodiments have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention.

What is claimed is:

1. An antenna assembly, comprising:

a reflector comprising a center opening;

a feed-antenna subassembly situated in front of the reflector, wherein the feed-antenna subassembly comprises a feed tube that houses at least one of: a transmitter circuit and a receiver circuit;

a rear housing situated behind the reflector, wherein the rear housing is coupled to a front side of the reflector via the center opening, wherein the rear housing comprises a center cavity, and wherein a back end of the feed tube can be inserted in and coupled to the center cavity; and a pole-mounting bracket comprising a base plate and a back plate, wherein the base plate is situated between the reflector and the rear housing, and wherein the base plate can be coupled to the reflector and the rear housing in such a way that decoupling between the base plate the reflector requires a prior decoupling between the feed-antenna subassembly and the rear housing and a prior decoupling between the rear housing and the reflector.

2. The antenna assembly of claim 1, wherein the feed-antenna subassembly further comprises a sub-reflector coupled to at least one of: the transmitter circuit and the receiver circuit.

3. The antenna assembly of claim 1, wherein the at least one of the transmitter circuit and the receiver circuit is located on a printed circuit board (PCB), and wherein the PCB further comprises a data port that is physically accessible via a window on the feed tube and a corresponding window on the rear housing.

4. The antenna assembly of claim 3, wherein the data port is an Ethernet port, and wherein the Ethernet port allows power over Ethernet.

5. The antenna assembly of claim 1, wherein the feed tube is coupled to the center cavity of the rear housing via a push latch.

6. The antenna assembly of claim 1, wherein the base plate of the pole-mounting bracket can be coupled to the reflector via a slide-latch mechanism.

7. The antenna assembly of claim 6, wherein the rear housing can be coupled to the reflector via a number of push latches that can be pushed through the center opening of the reflector, and wherein the rear housing further comprises an outer shell that is coupled to both the reflector and the base plate of the pole-mounting bracket.

8. The antenna assembly of claim 7, wherein the outer shell includes a number of extruding studs that are inserted into a number of holes on the reflector via corresponding through holes on the base plate, thereby serving as precision locator pins, accommodating for tolerances in fabrication, and preventing slips between the reflector and the base plate.

9. The antenna assembly of claim 1, wherein the reflector includes one of: a parabolic dish and a parabolic grid.

10. The antenna assembly of claim 1, wherein the back plate of the pole-mounting bracket can be coupled to a pole clamp for mounting onto a pole, and wherein the pole clamp can be rotated within a predetermined range against a pivot point on the back plate.

11. A method for assembling an antenna assembly, comprising:

attaching a base plate of a pole-mounting bracket to a backside of a reflector;

attaching a rear housing comprising a center cavity and an outer shell to the reflector by pushing a rim of the center cavity through a center opening on the base plate and a corresponding center opening on the reflector to allow a number of push latches located on the rim of the center cavity to latch onto a front side of the reflector, wherein attaching the rear housing to the reflector further locks the base plate to the reflector, thereby preventing the base plate from being removed from the reflector before the rear housing is removed; and inserting a back end of a feed-antenna subassembly into the center cavity of the rear housing, wherein the feed-antenna subassembly comprises a feed tube that houses at least one of: a transmitter circuit and a receiver circuit.

12. The method of claim 11, wherein the feed-antenna subassembly further comprises a sub-reflector coupled to at least one of: the transmitter circuit and the receiver circuit.

13. The method of claim 11, further comprising coupling a cable, via a window on the feed tube and a corresponding window on the rear housing, to a data port on a printed circuit board (PCB) housed inside the feed tube, and wherein the PCB comprises the at least one of the transmitter circuit and the receiver circuit.

14. The method of claim 13, wherein the data port is an Ethernet port, and wherein the Ethernet port allows power over Ethernet.

15. The method of claim 11, wherein inserting the back end of a feed-antenna subassembly into the center cavity involves latching a push latch located on the back end of the feed-antenna subassembly to a sidewall of the center cavity.

16. The method of claim 11, wherein attaching the base plate of a pole-mounting bracket to the backside of a reflector involves engaging a slide-latch mechanism.

17. The method of claim 16, wherein the outer shell further includes a number of extruding studs that are inserted into a number of holes on the reflector via corresponding through holes on the base plate, thereby serving as precision locator pins, accommodating for tolerances in fabrication, and preventing slips between the reflector and the base plate.

18. The method of claim 11, wherein the reflector includes one of: a parabolic dish and a parabolic grid.

19. The method of claim 11, further comprising coupling the back plate of the pole-mounting bracket to a pole clamp, and wherein the pole clamp can be rotated within a predetermined range against a pivot point on the back plate.

20. A pole-mounted radio, comprising:

a wireless receiver and/or transmitter circuit;

an L-shaped pole-mounting bracket for mounting the radio on a pole, wherein the pole-mounting bracket includes a back plate coupled to the pole and a base plate;

a reflector attached to the base plate of the pole-mounting bracket via a slide latching mechanism, wherein a center opening on the reflector is aligned to a center opening on the base plate; and a feed antenna that passes through center openings on the reflector and the base plate, wherein the feed antenna includes a feed tube that houses the receiver and/or transmitter circuit and a supporting housing that supports the feed tube, wherein the supporting housing is attached to the reflector via a number of push latches that are pushed through the center openings on the reflector and the base plate, wherein the supporting housing further comprises a number of locator pins coupled to both the reflector and the base plate, and wherein the locator pins accommodate fabrication tolerance and act as a lock for the slide latching mechanism.

21. The pole-mounted radio of claim 20, wherein the feed antenna further comprises a sub-reflector coupled to the receiver and/or transmitter circuit.

22. The pole-mounted radio of claim 20, wherein a portion of the feed tube is inserted into a center cavity on the supporting housing, wherein the portion of the feed tube includes an access window for accessing a data port on a printed circuit board (PCB) enclosed within the feed tube.

23. The pole-mounted radio of claim 22, wherein the data port is an Ethernet port that enables power over Ethernet.

24. The pole-mounted radio of claim 20, wherein the reflector includes one of: a parabolic dish and a parabolic grid.

25. The pole-mounted radio of claim 24, wherein if the reflector includes a parabolic grid, the parabolic grid can be attached to the back plate of the pole-mounting bracket in an orientation that includes one of: a first orientation corresponding to a horizontal polarity, and a second orientation corresponding to a vertical polarity.

26. A method for assembling a pole-mounted radio, comprising:

attaching an antenna reflector to a base plate of a pole-mounting bracket, wherein attaching the antenna reflector to the base plate involves:

aligning a center opening on the antenna reflector to a center opening on the base plate, and engaging a slide latching mechanism;

attaching a feed antenna to the antenna reflector, wherein the feed antenna includes a feed tube and a supporting housing that supports the feed tube, wherein attaching a feed antenna to the antenna reflector involves:

attaching the supporting housing to the antenna reflector by pushing a number of push latches through the center openings on the antenna reflector and the base plate;

aligning and inserting a number of locator pins into corresponding holes on both the antenna reflector and the base plate, wherein the locator pins accommodate fabrication tolerance and act as a lock for the slide latching mechanism; and inserting the feed tube into a center cavity within the supporting housing.

27. The method of claim 26, further comprising:

inserting a printed circuit board (PCB) into the feed tube, wherein the PCB includes at least one of: a transmitter circuit and a receiver circuit.

28. The method of claim 27, further comprising attaching a cable to an Ethernet port on the PCB via a window on the feed tube, wherein the Ethernet port enables power over Ethernet.

29. The method of claim 26, the antenna reflector includes one of: a parabolic dish and a parabolic grid.

30. The method of claim 29, wherein if the antenna reflector includes a parabolic grid, the method further comprising aligning the parabolic grid to obtain one of: a horizontal polarity, and a vertical polarity.

* * * * *